US005097538A

United States Patent [19]

Feuling

[11] Patent Number: 5,097,538

[45] Date of Patent: Mar. 24, 1992

[54] HELMET

[75] Inventor: James J. Feuling, Ventura, Calif.

[73] Assignee: Feuling Engineering, Inc., Ventura, Calif.

[21] Appl. No.: 535,513

[22] Filed: Jun. 11, 1990

[51] Int. Cl.[5] ..... A42B 1/06

[52] U.S. Cl. ..... 2/410; 2/422; 2/425

[58] Field of Search ..... 2/10, 410, 411, 422, 2/424, 425

[56] References Cited

U.S. PATENT DOCUMENTS

| | | | |
|---|---|---|---|
| 3,548,410 | 12/1970 | Parker | 2/424 |
| 4,370,758 | 2/1983 | Mattheis | 2/423 |
| 4,555,816 | 12/1985 | Broersma | 2/425 |
| 4,586,197 | 5/1986 | Hubbard | 2/410 |
| 4,612,675 | 9/1986 | Broersma | 2/424 |
| 4,903,350 | 2/1990 | Gentes et al. | 2/421 |

FOREIGN PATENT DOCUMENTS

| | | | |
|---|---|---|---|
| 131929 | 1/1985 | European Pat. Off. | 2/410 |
| 287145 | 10/1988 | European Pat. Off. | 2/411 |
| 3305735 | 8/1984 | Fed. Rep. of Germany | 2/410 |
| 253759 | 2/1988 | Fed. Rep. of Germany | 2/411 |
| 2236437 | 3/1975 | France | 2/410 |
| 2402455 | 5/1979 | France | 2/424 |
| 6324083 | 5/1988 | Japan | 2/411 |
| 8703457 | 6/1987 | PCT Int'l Appl. | 2/424 |
| 671864 | 10/1989 | Switzerland | 2/410 |

*Primary Examiner*—Werner H. Schroeder
*Assistant Examiner*—Michael A. Neas
*Attorney, Agent, or Firm*—Frank D. Gilliam

[57] ABSTRACT

The disclosure is directed to an improved aerodynamic helmet. The helmet has a continuous aerodynamic curvilinear front, side and top surfaces whereby the fluid flowing over and around the sides of the helmet flows in a substantially continuous flow direction from the forward curved area aft of a straight area at the greatest width or largest transverse dimensions of the helmet after leaving the surface influence thereof. The continuous transverse surface around the outer periphery of the helmet at or slightly aft of the greatest width area is provided with a fluid flow termination surface or trailing edge causing the normal direction of the fluid flow around the helmet to break loose from the surface of the helmet and continue in substantially the same direction after passing the termination or trailing edge thereby preventing turbulence to the flow rather than allowing the fluid flow to follow the surface and flow around a portion of the smaller dimension back surface of the helmet before separating therefrom which creates turbulence behind the helmet and unwanted lift thereto. The improved helmet lowers wind drag compared to the conventional helmet by about 40%.

6 Claims, 1 Drawing Sheet

HELMET

BACKGROUND OF THE INVENTION

The invention is directed to personal helmets worn for wearer head protection in a number of sports and particularly to an improved aerodynamic helmet which reduces the fluid flow resistance encountered by high speed fluid flow therearound.

There has been a continual evolution of personal helmets used for head protection and many new innovations in helmet design and construction exist in the present state of the helmet art.

Generally speaking, state of the art helmets are designed to provide a smooth or slick curvilinear outer surface with the only rectilinear surface being the lower head entry surface parallel with the shoulder line of the wearer. Helmets are currently manufactured by many different manufactures. Although the principle purpose of the helmet is to protect the head of the wearer and most accomplish this to some degree, the helmet generally has a slick smooth outer surface appearance to the viewer of the helmet to give the impression of low or no resistance to fluid flowing thereacross and to enhance the overall all aesthetic appearance of the wearer and the wearer's surrounding environment.

State of the art helmets include those helmets having the trademarks SHOEI, BELL, BIEFFE, NOLAN, ARAI and others.

FIGS. 1 and 2 depicts a side and front view showing respectfully of a state of the art helmet A manufactured by SHOEI. The helmet shown in FIGS. 1 and 2 has a typical outer shell B design substantially found in all state of the art helmets. In the typical helmet the fluid flow, shown by arrows C, around the outer skin D of the shell B of the helmet tends to follow the surface of the shell including a portion of the trailing or back surface E in the rear of the head of the wearer due to "skin effect". Because of this so called "skin effect" a substantial amount of the fluid flowing past the widest width or transverse portion of the helmet outer surface continues to follow the outer surface toward the back of the helmet for approximately 7 degrees of the diverging helmet surface where the flow then brakes free. This effect creates a considerable amount of turbulence to the fluid flow at the rear of the helmet creating buffeting or vibrating of the helmet and the helmet wearer's head at certain relative helmet and fluid speeds and causing lift to the helmet due to the aerodynamic air flow around the helmet, i.e. airplane wing effect. Considering the fact that the relative speed between the wearer and the surrounding air covers a wide range between say bicycle riders and race car drivers this buffeting or vibrating and lift condition creates a physical discomfort and fatigue to the wearer at all speeds as well as creating a resistance to the fluid flow past the helmet.

Until the emergence of the present invention there has not been a compact or reasonably sized aerodynamicly designed helmet that substantially eliminates the turbulence which causes helmet buffeting or vibrating created by relative fluid flow along the helmet surface and unwanted helmet lift.

SUMMARY OF THE INVENTION

As aforementioned, the invention is directed to helmet which is dynamicly designed to virtually eliminate the turbulence created by skin effect between the flow of fluid along the helmet divergent surface between the widest width or transverse portion and the smaller or rear surface of the helmet. This is accomplished by providing a defined termination surface at the widest portion of the helmet prior to the fluid reaching a distance which creates an angle 0° greater than 7 degrees of from the widest width of the helmet toward the rear thereof. This termination surface is a squared off surface or defined lip of substantially 90 degrees relative to the defined termination surface of the helmet. Newly constructed helmets encompassing the invention may be formed with a perpendicular rectilinear rear surface or a definite step between the largest transverse cross-sectional dimension and the smaller curvilinear back surface of the helmet. For an existing helmet, a band with a outer flat surface is fixedly positioned adjacent to the widest width area of the helmet and the width of the band extends parallel thereto for a short distance rearwardly and away from the helmet's normally curvilinear rear surface creating a flow surface termination or step thereby.

In newly constructed helmets, the equivalent to the band may be formed into the helmet shell or the rear fluid flow surface of the helmet can be squared off.

It is a object of this invention to provide a personal helmet which substantially eliminates buffeting or vibrations during use by reducing resistance to relative fluid flow thereacross by approximately 40% through a wide range of relative fluid flow and helmet speeds.

Another object of this invention is to provide a helmet which creates a low pressure area at the rear thereof through a wide range of fluid and helmet relative speeds.

Still another object of this invention is to provide an adapter for attachment to a state of the art helmet to substantially eliminated the buffeting or vibrations and reduce resistance to relative fluid thereacross through a wide range of relative fluid and helmet speeds.

Yet another object of this invention is to provide low pressure at the rear downstream surface of the helmet and provide openings therethrough so that vent air entering the front of the helmet is caused to flow around the wearer's head through the helmet and out the rear openings toward the low pressure area.

Yet another object of this invention is to provide a helmet wherein substantially eliminates all of the lift created by the aerodynamic shape of the helmet.

These and other objects and advantages of the present invention will become apparent to those skilled in the art after considering the following detailed specification in which the preferred embodiment are described in conjunction with the accompanying drawing Figures.

BRIEF DESCRIPTION OF THE DRAWING FIGURES

DETAILED DESCRIPTION OF THE PREFERRED EMBODIMENTS

Figure 1:
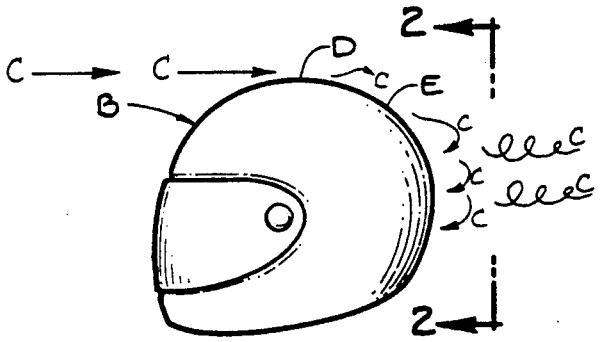
FIG. 1 PRIOR ART
FIG. 1 depicts a side view showing of a state of the art helmet.
Figure 2:
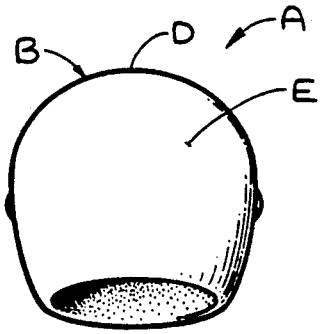
FIG. 2 PRIOR ART
FIG. 2 is a showing taken along line 2—2 of FIG. 1.

Referring now to the prior art showing of the state of the art helmets. FIG. 1 depicts a side view of the state of the art helmets A and FIG. 2 a is a rear showing thereof. The arrows C represent relative fluid flow across the surface of the helmet A. Note as the fluid flow leaves the widest portion of the helmet and follows the helmet surface rearwardly past approximately 7 degrees of direction change the flow separates from the surface of the helmet and begins to create turbulence at the rear of the helmet and lift from the bottom of the helmet. This turbulence and lift increase as the fluid extends farther downstream at the rear of the helmet. Obviously, as the relative speed of the fluid flow and the helmet increase the turbulence and lift increases. The turbulence causes the helmet to vibrate of buffet shaking the head of the wearer who must exert neck muscles to steady the vibrations and the lift forces on the helmet. This places stress on the wearer during use of the helmet and tires the wearer of the helmet.

Figure 3:
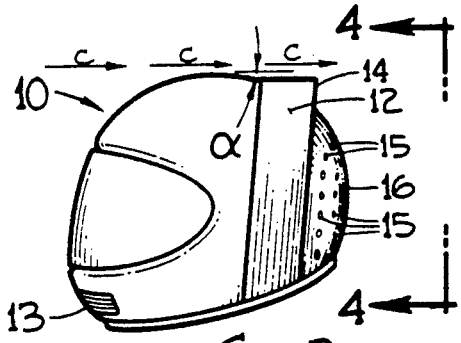
FIG. 3 depicts the helmet of FIG. 1 with a band of the present invention attached thereto.
Figure 4:
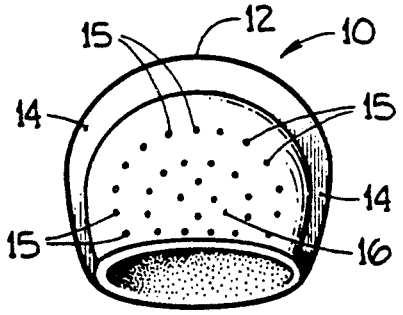
FIG. 4 is a showing of FIG. 3 taken along line 4—4.

Referring now specifically to drawing FIGS. 3 and 4, drawing FIG. 3 depicts a side view and drawing FIG. 4 is a rear view of one embodiment of a helmet 10 employing the present invention. The direction of relative fluid flow is shown as arrows C. A band 12 is attached to a conventional helmet such as, helmet A shown in drawing FIGS. 1 and 2. The band 12 continues the widest transverse or width surface of the helmet rearward a short distance and then abruptly terminates at a substantially perpendicular end or rear surface 14. The end or rear surface 14 is substantially perpendicular to the outer air flow surface of the band 12 and is rectilinear or straight surface. The rear area 16 immediately behind the helmet is substantially void of any turbulence to the fluid flow and a low pressure area is created in the general area. The band 12 may be attached by any convenient means such as adhesive or the like. A vent opening 13 is located at the front of the helmet out of interference of the user. This vent allows head cooling air to enter the helmet. This air entering the opening 13 flows around the head of the helmet wearer cooling the head and is then drawn out through rear apertures 15 or single aperture 17 by the low pressure created at the rear surface of the helmet.

Figure 5:
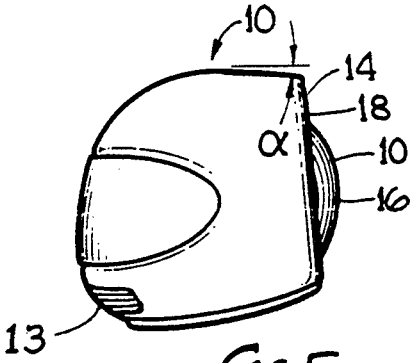
FIG. 5 depicts a showing of the helmet of the present invention with a built in band extending the widest width portion of the helmet rearwardly a short distance.

Referring now specifically to drawing FIG. 5, in this embodiment of the present invention the equivalent of the band 12 of drawing FIGS. 3 and 4 is formed into the shell of the helmet. The widest portion of the helmet shell terminating at 14 and also diverging to form a rear rectilinear or straight surface to the helmet like the band 12 of FIGS. 3 and 4.

Figure 6:
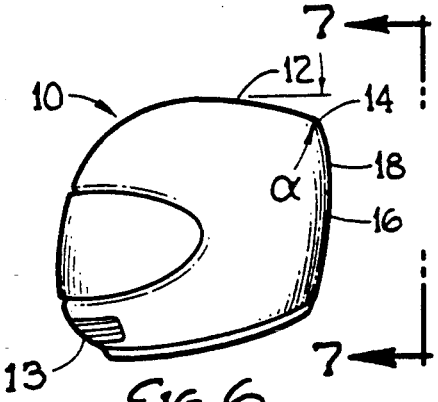
FIG. 6 depicts a helmet of the present invention with the outer shell extended further rearward than in the state of the art helmet with the rear surface of the helmet centered thereon.
Figure 7:
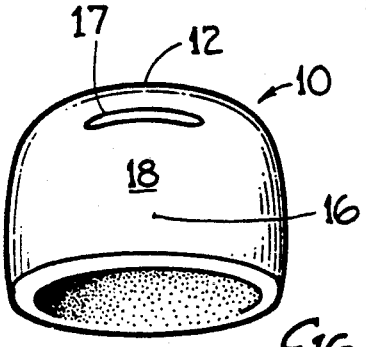
FIG. 7 is a showing of FIG. 6 taken along line 7—7.

Referring now to drawing FIGS. 6 and 7, these Figures depict respectively the side and rear view of yet another embodiment of the helmet of the present invention. In this embodiment the helmet at the widest width of the shell extends rearwardly a greater distance than described and shown in the other embodiments prior to termination. This extension is sufficient to extend beyond the rear portion of the helmet.

It should be understood that the front opening 13 and the rear apertures 15 or aperture 17 can be employed in any of the embodiments described herein.

The physical effect of the air flow substantially straight back from the widest portion of the helmet rather than flowing along the surface of the helmet substantially eliminates the lift to the helmet caused by "wing lift effect".

While there have been shown and described preferred embodiments of a helmet in accordance with the invention, it will be appreciated that many changes and modifications may be made therein without, however, departing from the essential spirit thereof.

What is claimed is:

1. An improved helmet comprising:

an outer shell surface, said outer shell surface increasing in a downstream width from a front surface to a maximum width and decreasing downstream therefrom and said outer shell surface being effectively extended downstream of said maximum width at a location having an angle no greater than 7 degrees in decreasing downstream helmet width from said maximum width by means of a helmet attached band having an outer surface which is a continuation of substantially the widest width surface of said outer shell surface.

2. The invention as defined in claim 1 wherein the rear downstream surface of said band forms a rear rectilinear surface to at least a portion of the rear surface of said helmet.

3. The invention as defined in claim 2 wherein said band outer surface and said rear rectilinear surface are substantially at right angles.

4. The invention as defined in claim 1 wherein a low pressure area is created rearwardly of the band outer surface.

5. The invention as defined in claim 4 additionally comprising first openings in the front surface and second openings in the surface of said shell rearwardly of said band outer surface whereby air entering said first openings is drawn to the low pressure area through said second openings.

6. The invention as defined in claim 5 wherein said first openings are located near the chin of the wearer and said second openings are spaced apart around the surface at the rear of the helmet within the low pressure area thereof.

* * * * *